US009759428B2

(12) United States Patent
Hyson

(10) Patent No.: US 9,759,428 B2
(45) Date of Patent: Sep. 12, 2017

(54) OUTDOOR WOOD-BURNING BOILER

(71) Applicant: Mark Hyson, Markham, VA (US)

(72) Inventor: Mark Hyson, Markham, VA (US)

( * ) Notice: Subject to any disclaimer, the term of this patent is extended or adjusted under 35 U.S.C. 154(b) by 478 days.

(21) Appl. No.: 14/504,444

(22) Filed: Oct. 2, 2014

(65) Prior Publication Data

US 2016/0097540 A1 Apr. 7, 2016

(51) Int. Cl.
*F24C 1/14* (2006.01)
*F24B 5/02* (2006.01)
*F24B 9/00* (2006.01)

(52) U.S. Cl.
CPC ..... *F24B 5/023* (2013.01); *F24B 9/00* (2013.01); *F24H 2230/00* (2013.01)

(58) Field of Classification Search
CPC .. F24B 5/023; F24B 1/193; F23G 5/12; F23G 7/105; F23H 3/00; F23H 3/02; F23L 1/00; F22B 1/284; F22B 37/003; F22B 37/483; F22B 21/00; F28G 9/00; F28G 15/00; F28G 1/02; F28G 15/08; F28G 3/04
See application file for complete search history.

(56) References Cited

U.S. PATENT DOCUMENTS 1,568,849 A * 1/1926 Kleinsmith ..... F24B 9/00 126/1 R
3,269,383 A 8/1966 Maasberg
4,159,801 A * 7/1979 Roland ..... F24B 1/183 126/502
4,223,833 A * 9/1980 Ebbers ..... F24B 1/1902 126/509
4,232,653 A 11/1980 Otterpohl
4,303,056 A * 12/1981 Slavik ..... F24B 1/1902 126/502
4,387,699 A * 6/1983 Murch, Jr. ..... F24B 1/006 126/61
4,549,526 A * 10/1985 Lunde ..... F23L 17/005 126/367.1
4,574,712 A 3/1986 David
5,139,012 A 8/1992 Furman et al.
8,186,286 B2 5/2012 Brazier et al.

* cited by examiner

*Primary Examiner* — Jason Lau
(74) *Attorney, Agent, or Firm* — Kilyk & Bowersox, P.L.L.C.

(57) ABSTRACT

An outdoor wood-burning boiler is provided that includes a wood-burning enclosure, a wood support structure, and an air supply system configured for supplying air to wood that is supported by the wood support structure. The air supply system includes conduits for carrying a flow of air. At least one conduit can extend through a sidewall of the enclosure such that an end of the conduit is located outside of the enclosure. The end can include a re-closable closure. The re-closable closure can be configured to be opened from outside of the enclosure and provide access to the interior of the conduit so the conduit can be cleaned. The end and the re-closable closure can instead be located inside the enclosure and accessible through an access panel. An air supply conduit system is also provided that can be installed after-market or as original equipment.

7 Claims, 5 Drawing Sheets

OUTDOOR WOOD-BURNING BOILER

FIELD OF THE INVENTION

The present invention relates to outdoor wood-burning boilers and methods of cleaning the same.

BACKGROUND OF THE INVENTION

Outdoor wood-burning boilers typically include air supply tubes that carry air from a fan or pump into the interior of the wood-burning enclosure. When there is no need for air to be pumped into the boiler, for example, when the temperature of water to be heated by the boiler is sufficiently high, exhaust smoke from the burning wood seeps into the air supply tubes and fouls them. The smoke and other unburned combustion products, including creosote, can coat the insides of the air supply tubes, reducing the efficiency of the boiler and posing an inner-tube fire risk. Cleaning the air supply tubes requires ceasing operation of the boiler, cooling the boiler, and disassembly of the boiler. A need exists for an outdoor wood-burning boiler that includes an air supply system that can be easily cleaned without the need to stop operation of and cool down the boiler.

SUMMARY OF THE INVENTION

An outdoor wood-burning boiler is provided that comprises an enclosure for retaining burning wood. The enclosure can comprise a sidewall, a wood support structure, and an air supply system configured for supplying a flow of air to wood that is supported by the wood support structure, for example, to increase the rate of combustion or stoke burning wood, or to facilitate ignition of wood. Although wood is exemplified herein, it is to be understood that other combustible materials can be combusted by the boiler instead, for example, biomass fuel, charcoal, pellets, paper products, cardboard, newspaper, and the like.

The air supply system can comprise one or more conduits for carrying a flow of air. The one or more conduits can include at least one conduit that extends through the enclosure sidewall, has a first end located outside of the enclosure, and comprises a re-closable closure connected to the first end, outside of the enclosure. The conduit can have an interior, for example, that directs and distributes the flow of air, and the re-closable closure can be configured to provide access to the interior. The re-closable closure can be opened outside of the enclosure and can provide access to the interior of the conduit.

More than one conduit of the air supply conduit system can be accessed from a single re-closable closure.

A conduit with a re-closable closure at an end thereof can have the end with the re-closable closure located inside the enclosure. The end can be accessible by an access panel and the re-closable closure can be accessed by opening or removing the access panel. The closure can be integrated with the end, removable from the end, comprise a threaded connection, a combination thereof, or the like.

An air supply conduit system is provided by the present invention and can comprise a system of air supply conduits configured to be installed in an enclosure of a wood-burning boiler, either as original equipment or as an after-market feature.

BRIEF DESCRIPTION OF THE DRAWINGS

The present invention can be even more fully understood with the reference to the accompanying drawings which are intended to illustrate, not limit, the present invention.

DETAILED DESCRIPTION OF THE INVENTION

Figure 1:
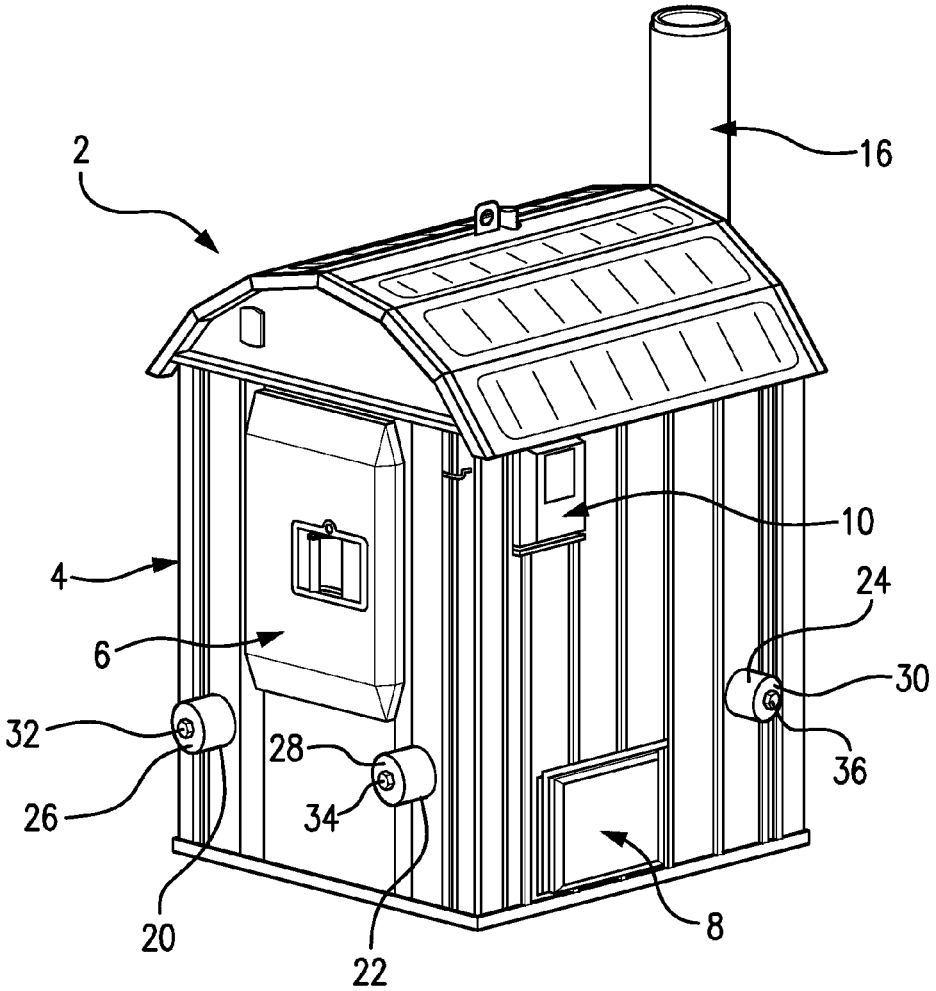
FIG. 1 is a right, top, perspective view of a wood-burning boiler comprising an air supply conduit system according to one or more embodiments of the present invention.

An outdoor wood-burning boiler is provided that comprises an enclosure, a wood support structure in the enclosure, and an air supply system configured for supplying air to wood supported by the wood support structure. The enclosure comprises at least one sidewall. The air supply system comprises one or more conduits for carrying and directing a flow of air. A blower can be provided for moving air through the air supply conduit system. One or more of the conduits extends through the enclosure sidewall and has an end located outside of the enclosure. A re-closable closure is connected to the end outside of the enclosure. The interior of the conduit extending outside the enclosure can be accessed by opening or removing the re-closable closure. The interior can thereby be swept or otherwise cleaned without a need to open the boiler enclosure or extinguish burning wood supported in the boiler.

The conduit that extends through the enclosure sidewall can also extend through the same or another enclosure sidewall at a second location and can further comprise a second end outside of the enclosure and a second re-closable closure connected to the second end. The second re-closable closure can be configured to be opened outside of the enclosure, and the second re-closable closure can be configured to provide access to the interior of the conduit. The re-closable closures can be positioned relative to each other such that when both are opened or removed a cleaning implement can be extended through a first end of the conduit, completely through the interior of the conduit, and optionally out of the second end of the conduit. From the first end of the conduit soot, creosote, and other built-up material in the interior can be forced out the second end of the conduit. The enclosure can have a first sidewall and a second, opposite sidewall, and the first end of the conduit can extend through the first sidewall while the second end extends through the second, opposite sidewall.

The sidewall can comprise a first sidewall and a second, opposite sidewall. The system can comprise a conduit that is U-shaped. A first end of the U-shape and a second end of the U-shape can both be located outside of the enclosure, and, for example, each end can extend outside of the enclosure from the same sidewall of the enclosure.

An outdoor wood-burning boiler can be provided that comprises an enclosure comprising a sidewall, an access panel formed in the sidewall, a wood support structure inside the enclosure, and an air supply system including at least one conduit having an end within the enclosure and adjacent the access panel. A re-closable closure is connected to the first end and adjacent the access panel and the re-closable closure is positioned such that when the access panel is opened or removed the re-closable closure can be accessed. The re-closable closure can be configured to provide access to the interior of the conduit so that, for example, the conduit can be swept or otherwise cleaned. The access panel can be removable from the enclosure. The enclosure can comprise a hinge and the access panel can be connected to the enclosure by the hinge. The enclosure can comprise a second access panel formed in the sidewall, the conduit can have a second end within the enclosure and adjacent the second access panel. The conduit can comprise a second re-closable closure connected to the second end and adjacent the second access panel. The re-closable closures can respectively be positioned such that when the first and second access panels are opened, the re-closable closures are opened. A sweeper or other cleaning implement can be extended through the access panel, completely through the interior of the conduit, and optionally out of the enclosure through the second access panel. The enclosure sidewall can optionally comprise a first sidewall and a second, opposite sidewall, the conduit can be U-shaped, and the access panels can both be located on the first sidewall. The sidewall optionally comprises a first sidewall and a second, opposite sidewall, one access panel is located on the first sidewall, and the second access panel is located on the second, opposite sidewall.

An air supply conduit system can be provided for an outdoor wood-burning boiler. The system comprises one or more conduits each having an interior and defining an air flow path, and at least one of the conduits has an end configured to be opened and closed by a re-closable closure. Each conduit can independently be tubular, and can have a circular, oval, square, rectangular, oblong, polygonal, or the like, hollow cross-section. The one or more conduits can comprise a single conduit, or a plurality of conduits. The re-closable closure can be configured to be opened to provide access to the interior of the conduit, for example, so the interior can be swept or otherwise cleaned. The system can include one or more inlets configured to be connected to an air movement device, such as a blower, for supplying a flow of air through the interior of each of the one or more conduits. The conduits can have a plurality of air supply ports formed therein for directing respective portions of a flow of air out of the interiors. The ends of each conduit can be free of air supply ports.

At least two tubular conduits can be included in the air supply conduit system, which are parallel to each other, and can be in fluid communication with one another, for example, by a connecting conduit. Each of the two parallel conduits can have two ends, and the air supply conduit system can comprise a respective re-closable closure at each of the two ends of each of the two parallel conduits, for a total of four separate re-closable closures. The system can comprise a U-shaped conduit with two ends and a re-closable closure at each end.

Each re-closable closure can independently comprise a removable threaded closure, a hinged closure, a spring-biased closure, a sliding door, a flap, a threaded plug, a combination thereof, or the like. One or more ends of the conduit can comprise threads configured to engage re-closable closures in the form of removable threaded plugs. The re-closable closure can be a removable threaded closure that has threads on an external surface thereof and the end of the conduit to which the closure is configured to engage can have internal threads. Other closure devices can instead be used, for example, a non-threaded plug that can be clamped in place, frictionally engaged, or otherwise held in place at or in the end of the tubular conduit. A cap can be used, for example, having interior threads that thread onto exterior threads on the end of the conduit. Two or more different types of re-closable closures can be used. As an example, a threaded plug can be provided at one end of a conduit and a spring-biased flap can be provided at another end of the same conduit.

The air supply conduit system can comprise one or more inlets, and a first re-closable closure adjacent at least one of the inlets. The one or more inlets can be located, for example, between a blower and the remainder of the air supply conduit system. The first re-closable closure can be configured to be opened to provide access to the interior of at least one tubular conduit, access to the one or more inlets, or access to both. The first re-closable closure can be one of a pair of re-closable closures, wherein the two re-closable closures are located at opposite ends of an air supply conduit. The re-closable closures can be aligned with one another. The first re-closable closure can be part of two different pairs of re-closable closures and can provide access to two different conduits.

FIG. 1 is a right, top, perspective view of one example of a wood-burning boiler 2. Other designs or configurations are equally feasible using the aspects of the present invention. Boiler 2 is compatible with wood, coal, manufactured pellets, grains, waste agricultural materials, other combustible biomass materials, and the like. Boiler 2 comprises a formed steel enclosure 4 having a front door 6, an ash removal door 8, a side-mount operational controller panel 10, and an exhaust chimney 16. Boiler 2 also comprises a plurality of clean-out conduit ends 20, 22, and 24 extending out of enclosure 4 and providing access to the interiors of respective tubular conduits of an air supply conduit system, for example, system 200 shown in FIG. 2. An air blower or fan (not shown) can be provided to move air into and through the air supply conduit system. Each conduit end 20, 22, 24 has a respective re-closable closure 26, 28, 30 in the form of a threaded plug having exterior threads that thread into interior threads in the end of the tubular conduit. A hex-nut 32, 34, 36 is provided for screwing the respective plug into the conduit end, to close the conduit end, and also for unscrewing the plug to enable access to and cleaning of the interior of the respective conduit. Although a hex-nut is shown, it is to be understood that a square nut, a wing nut, or any other kind of nut or closure-manipulating fixture can be used instead. There is no need to stop the boiler, extinguish burning wood, or open any doors or panels to clean the tubular conduits. Even if access panels are included to hide and/or protect the conduit closures, access to the interiors of the conduits can nonetheless be easily facilitated. As an option, a sensor can be provided at each conduit end, which sends a signal to controller unit 10 indicating that a, or the, re-closable closure is not secure. In response, the controller unit can be configured to prevent the air blower from blowing air into the air supply conduit system during cleaning.

Figure 2:
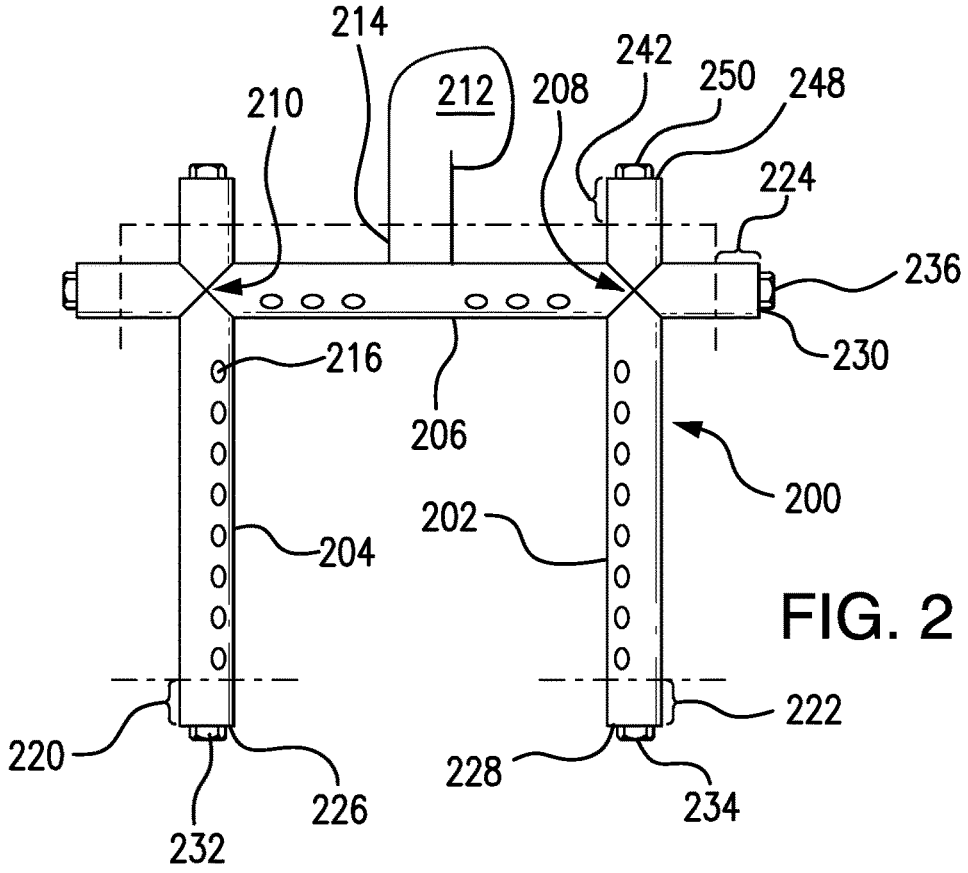
FIG. 2 is a top view of an air supply conduit system according to one or more embodiments of the present invention.

FIG. 2 is a top view of an example of an air supply conduit system. Other configurations are possible and can be configured to meet the overall design of the boiler. FIG. 2 shows an air supply conduit system 200 comprising three interconnected conduits, 202, 204, and 206, and a blower 212 in fluid communication with conduit 206. Conduits 202 and 206 intersect at an intersection 208, and conduits 204 and 206 intersect at an intersection 210. Conduits 202, 204, and 206 each comprise air supply ports 216 located so as to direct air toward wood supported in a wood-burning boiler. Conduit 202 has an end 222 that extends outside of a boiler enclosure wall during use, the likely boiler enclosure wall position being shown in dashed lines. End 222 is closed by a re-closable closure 228 that comprises a hex-nut feature 234 that can be turned to open or close end 222 with re-closable closure 228. End 222 can instead be closed by a hinged, spring-loaded door or other re-closable closure device.

Conduit 204 has an end 220 that extends outside of a boiler enclosure wall during use, the likely boiler enclosure wall position being shown in dashed lines. End 220 is closed by a re-closable closure 226 that comprises a hex-nut feature 232 that can be turned to open or close end 220 with re-closable closure 226. End 220 can instead be closed by a hinged, spring-loaded door or other re-closable closure device.

Conduits 206 has an end 224 that extends outside of a boiler enclosure wall during use, the likely boiler enclosure wall position being shown in dashed lines. End 224 is closed by a re-closable closure 230 that comprises a hex-nut feature 236 that can be turned to open or close end 224 with re-closable closure 230. End 224 can instead be closed by a hinged, spring-loaded door or other re-closable closure device.

To even further facilitate cleaning, for example, of conduit 202, a second end 242 of conduit 202, opposite end 222, can optionally be provided with a re-closable closure, 248. Re-closable closure 248 can be removed or inserted by turning hex-nut head 250. Re-closable closures 228 and 248 are aligned with each other, and when both are removed or opened, a sweep can be pushed straight through conduit 202, without obstructions. Similarly, conduits 204 and 206 are provided with re-closable closures at both ends thereof.

Figure 3:
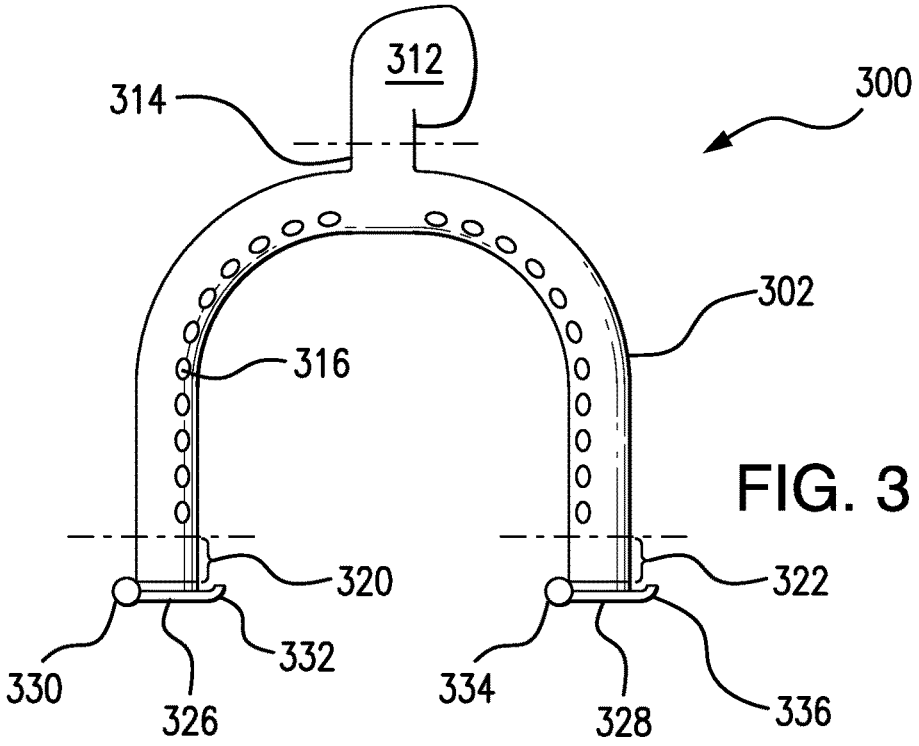
FIG. 3 is a top view of another air supply conduit system according to one or more embodiments of the present invention.

FIG. 3 is a top view of another example of an air supply conduit system. An air supply conduit system 300 can comprise a U-shaped conduit 302, and a blower 312, in fluid communication with one another at an inlet 314. Conduit 302 has a plurality of air supply ports 316 formed therein, and generally directed toward the inside of the U-shape. System 300 is intended to and can be used in a wood-burning boiler enclosure having enclosure wall positions as shown by the dashed-lines. Conduit 302 has two ends, 320 and 322, each configured to be positioned outside of a boiler enclosure. Ends 320 and 322 are recloseably closed by re-closable closures 326 and 328, respectively. Re-closable closure 326 comprises a spring-loaded hinge 330, and a cap 332, directly or indirectly connected to or integral with, hinge 320. Likewise, re-closable closure 328 comprises a spring-loaded hinge 334 and a cap 336, directly or indirectly connected to or integral with, hinge 334. A flexible sweep can be inserted into one end of conduit 302 and pushed all the way around and through conduit 302 and out the other end. As such, cleaning and collecting of soot and build-up can be accomplished on the same side of the boiler enclosure, and only a single sweep is needed to clean the conduit.

Figure 4A:
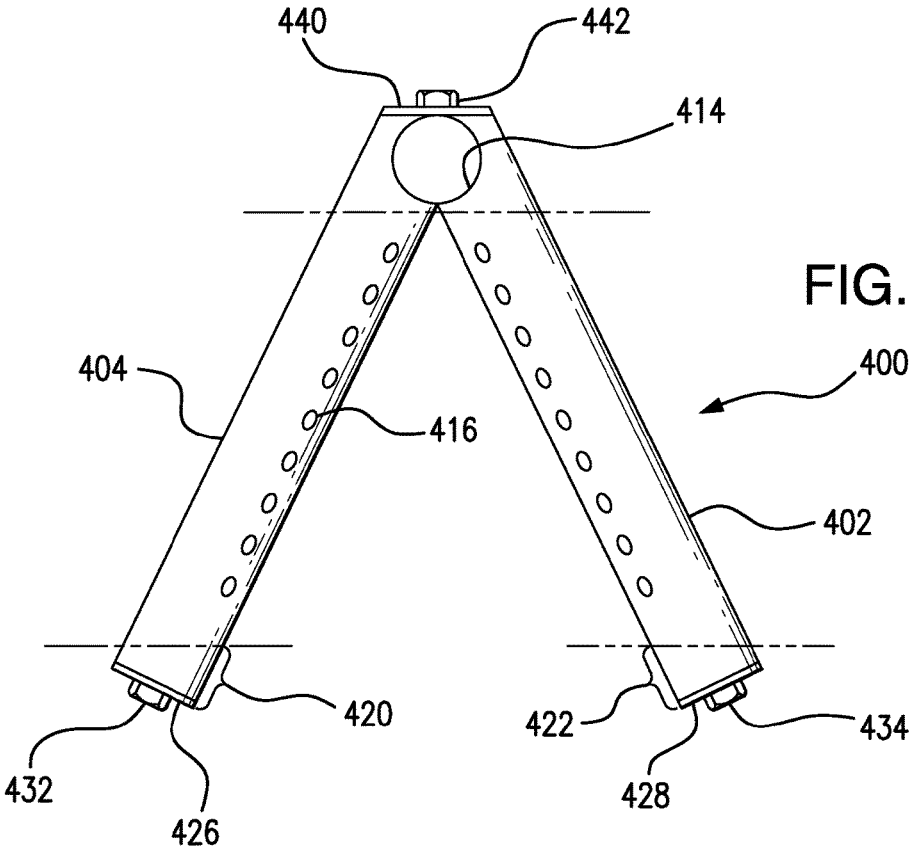
FIG. 4A is a top view of another air supply conduit system according to one or more embodiments of the present invention.

FIG. 4A is a top view of another example of an air supply conduit system. FIG. 4A shows an air supply conduit system 400 comprising two interconnected conduits, 402 and 404, that intersect at and adjacent an inlet 414. Inlet 414 can be configured to be operatively connected to a blower, such as blower 412, shown in FIG. 4B. Conduits 402 and 404 each comprise a plurality of air supply ports 416 positioned to direct respective flows of air towards wood supported in a wood-burning boiler. Conduit 402 has an end 422 that extends outside of a boiler enclosure wall during use, the likely boiler enclosure wall position being shown in dashed lines. End 422 is closed by a re-closable closure 428 that comprises a hex-nut feature 434 that can be turned to open or close end 422 with re-closable closure 428, that is by screwing on or unscrewing re-closable closure 428. End 428 can instead be closed by a hinged, spring-loaded door or other re-closable closure device. Conduit 404 has an end 420 that extends outside of the likely boiler enclosure wall line. End 420 is closed by a re-closable closure 426 that comprises a hex-nut feature 432 that can be turned to open or close end 420 with re-closable closure 426.

Figure 4B:
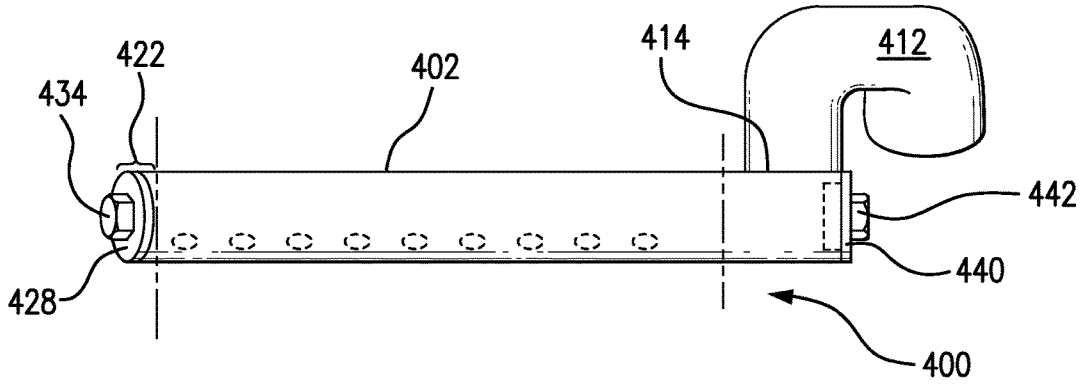
FIG. 4B is a side view of the air supply conduit system of FIG. 4A, and wherein a blower is connected to the system.

Each of conduits 402 and 404 can also be accessed through a re-closable closure 440 that is located opposite ends 420 and 422. Re-closable closure 440 can comprise a hex-nut 442. By removing each of re-closable closures 426, 428, and 440, the entire air supply conduit system 400 can be swept clean quickly and easily, even with a blower attached. The system is depicted with a blower 412 attached in FIG. 4B. In FIG. 4B, the same reference numerals referenced above with respect to FIG. 4A are used to identify the same respective features in FIG. 4B.

Figure 5A:
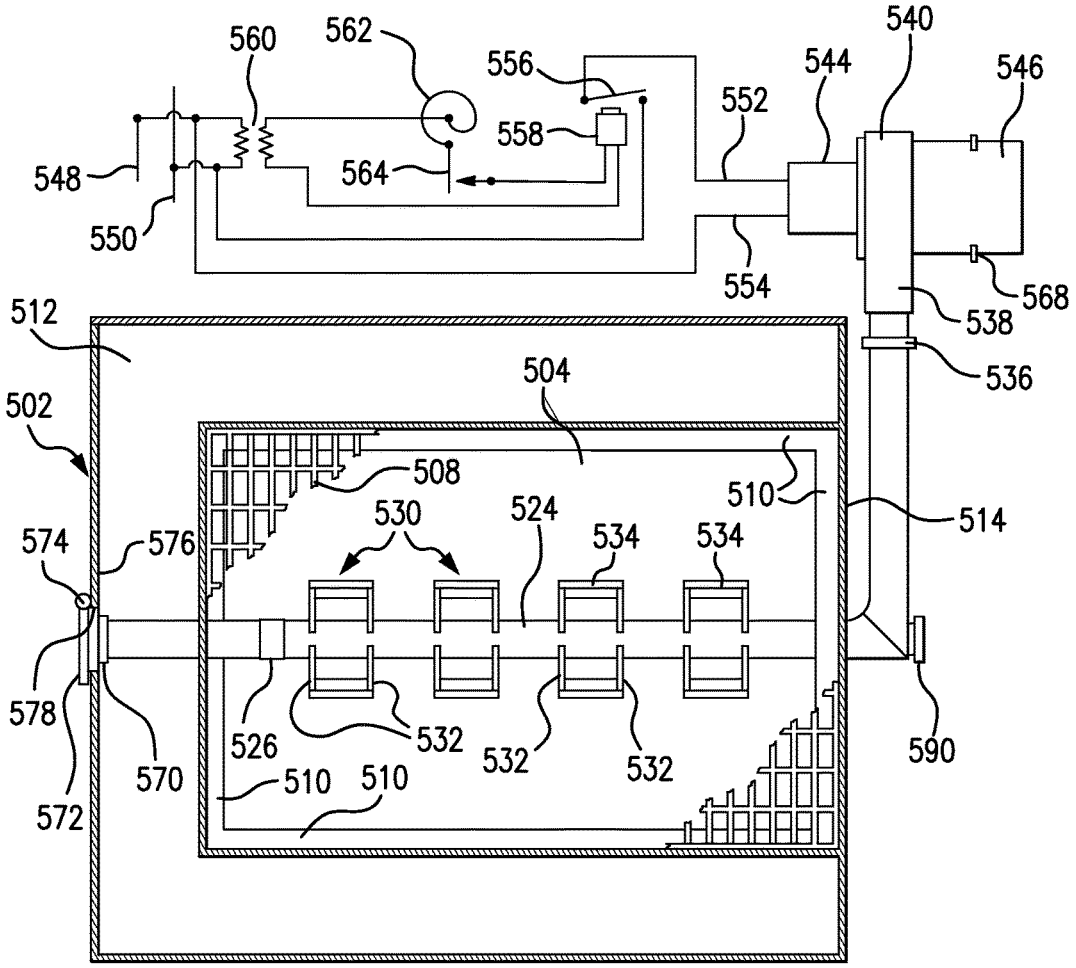
FIG. 5A is a combined top, cutaway, view, and schematic diagram, of a wood-burning boiler according to one or more embodiments of the present invention.

FIG. 5A shows an example of a wood-burning boiler 502. Wood-burning boiler 502 includes a body having walls forming a combustion chamber 504, the upper portion of which is provided with a flue or chimney connection not shown. An ash pit (not shown) is provided beneath combustion chamber 504 and divided therefrom by a horizontal, open-work grate 508 supported on ledges 510. An air plenum chamber 512 surrounds generally the sides, rear, and top of combustion chamber 504, but not the front. A front wall 514 is provided and has an upper door (not shown) which, when opened, provides access for inserting wood logs or the like into combustion chamber 504 to be supported on grate 508. A lower door (not shown) is also provided which, when opened, permits the removal of an ash tray disposed in the ash pit for receiving ashes falling through grate 508.

Air for combustion can be delivered by an air supply conduit system comprising a tubular conduit in the form of a pipe 524 sealed in front wall 514, and extending rearwardly along the midline of the furnace, just below grate 508. At a rearward end of pipe 524 is a re-closable closure 570 that can be opened to enable access to and cleaning of the inside of pipe 524. An access panel or door 572 is connected by a spring-loaded hinge 574 to a back wall 576 of wood-burning boiler 502. An opening 578 in back wall 576 is normally closed by access panel 572, but by pivoting open access panel 572 at hinge 574, re-closable closure 570 can be accessed through opening 578, and can be removed from the end of pipe 524. Opposite the rearward end of pipe 524, a second re-closable closure 590 is provided, which, if opened, can enable a straight linear path through pipe 524 between first re-closable closure 570 and second re-closable closure 590. Pipe 524 can easily be cleaned by pushing a sweeping device, such as a chimney sweep, all the through pipe 524. Ash, soot, and creosote in the inside of pipe 524 can thus be swept out of pipe 524, even during operation of wood-burning boiler 502. Second re-closable closure 590 can be same as, or different than first re-closable closure 570, and in some cases, each can be configured to be screwed onto and off of pipe 524.

Along each side of pipe 524, within combustion chamber 504, can be formed a series of longitudinally spaced apart orifices, each adapted to direct a jet of air horizontally outwardly when air is delivered to pipe 524 by a blower, as described below. The number and size of the orifices is a design consideration, depending primarily on the volume of the combustion chamber, and the air delivery capacity of the blower. The orifices can be generally evenly or unevenly spaced along the front-to-rear depth of the boiler. In connection with each orifice, there is provided an air deflection assembly 530 that includes a pair of side bars 532 fixed to and extending horizontally outwardly from pipe 524, respectively, at opposite sides of the orifice. A deflector plate 534 can be affixed to and extends between the outer ends of the side bars. Each deflector plate can be elongated in a direction parallel to pipe 524, but can be curved outwardly and then upwardly from its lower edge to deflect a horizontal jet of air emerging from the associated orifice upwardly toward and through grate 508. The horizontal and generally rectangular space defined by side bars 532, deflector plate 534 and pipe 524 can be vertically open, so that ashes sifting downwardly through the grate may fall through freely to the ash tray.

Externally of the boiler, pipe 524 can be connected by means of a flanged coupling 536 to a delivery conduit 538 of a blower housing 540 in which a blower fan driven by an electric motor 544 is operably mounted. Blower housing 540 can be equipped with an air intake conduit 546 for receiving atmospheric air for delivery to pipe 524. Blower motor 544 can be powered from electric line wires 548 and 550 through a circuit including wires 552 and 554, in which is interposed a normally open relay switch 556. A coil 558 of relay switch 556 can be controlled by a circuit from line wires 548 and 550, a transformer 560 for reducing the voltage, and a thermostat 562 including a normally open switch 564 which is closed by thermostat 562. When thermostat 562 calls for heat, it closes relay switch 556 and actuates blower motor 544. The thermostat can be disposed within the comfort zone to be heated by the furnace, and the control system can be standard within itself. Blower motor 544 can be used to provide a forced circulation draft, and can be controlled by a thermostatic switch disposed in the stack of combustion chamber 504, so as to prevent plenum circulation until the combustion chamber and stack rises to a pre-determined minimum temperature even after operation of blower 540 has re-established the combustion chamber fire. The thermostatic switch can also maintain the plenum circulation even after the cessation of operation of blower 540 has signaled the snuffing of the fire until the stack has fallen to a pre-determined low temperature. Such automatic stack switch controls are common and well known in the furnace art.

Disposed in air intake conduit 546 of blower 540 can be a damper, for example, constituting a circular disc pivoted in said conduit on an axis disposed in its own plane and vertically above the center thereof. The damper can be closed to seal conduit 546 against the passage of air there through. Edges of the damper above and below the pivot can respectively engage inner and outer annular flanges provided in the conduit. Each of the flanges can be provided with a gasket to improve the efficiency of the seal. The damper can be opened under the pressure against its outer surface generated by the operation of blower 540.

In operation, logs or other forms of wood can be first inserted in combustion chamber 504 after a door to the combustion chamber is opened. The wood can be initially ignited by any suitable means, and then the door can be closed. Provided that the door to the ash tray is also closed, then the only avenue by which air can enter the combustion chamber to support further combustion of the wood is through pipe 524. Whenever thermostat 562 calls for heat in the comfort zone, it actuates blower motor 544 to drive blower 540, drawing atmospheric air inwardly through conduit 546 to open the damper, and deliver air through pipe 524 to combustion chamber 504. The blower and air pipe are of course selected to have sufficient capacity to deliver a quantity of air fully adequate to support normal combustion in chamber 504, when the damper is open. More details about dampers, operation of dampers, and wood-burning boilers and features that can be used in or together with the present invention, can be discerned from U.S. Pat. No. 4,232,653 to Otterpohl, which is incorporated herein in its entirety by reference.

The combustion of wood produces quantities of ash. The open-work nature of grate 508 permits the ash to fall through freely, so as to prevent clogging. Although a grate is exemplified, it is to be understood that any suitable wood support structure can be used. To prevent ash from clogging the orifices of pipe 524, the orifices can be horizontally disposed so that falling ash will not fall into the orifices. The ash tray can be configured to be easily removed from the furnace through an ash door so that the ash can be disposed.

The damper can be useful because, without one, full combustion could be maintained, even with blower 540 turned off, by air drawn through the blower by the natural stack draft created by the heat of the fire. If the damper is completely sealed, the fire would immediately be completely snuffed out for lack of oxygen. Accordingly, a certain minimum residual degree of combustion can be allowed to continue to permit re-establishment of full combustion when the thermostat calls for heat. The degree of such residual combustion should be slight, preferably releasing an amount of heat less than even the minimum requirements of the comfort zone. In some cases, a supplemental damper can be provided.

Figure 5B:
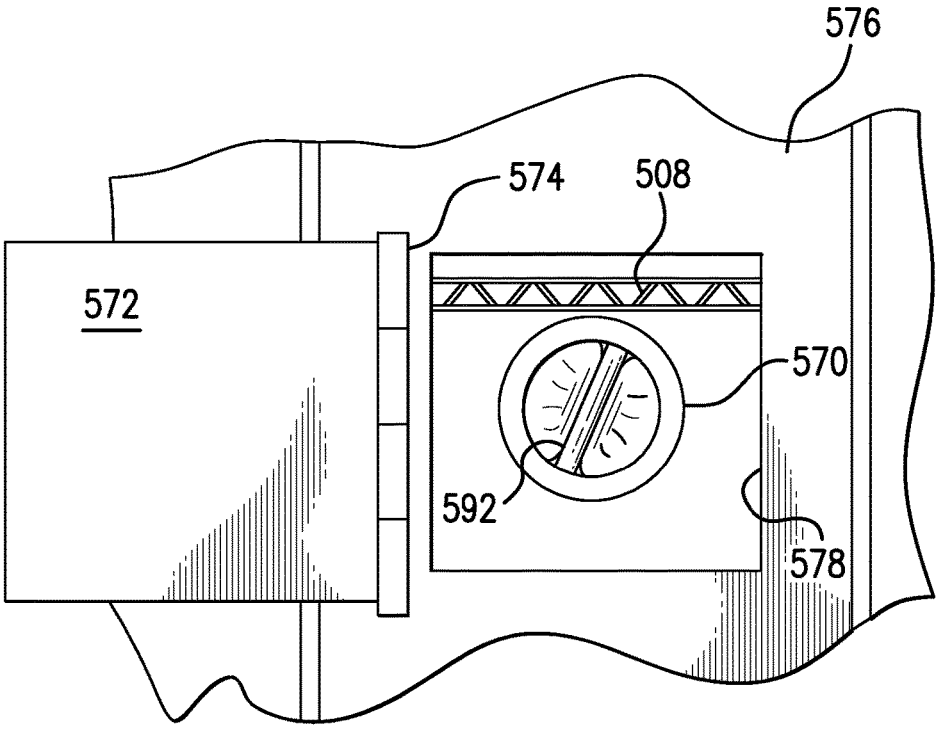
FIG. 5B is an enlarged back view of a portion of the system shown in FIG. 5A, and showing an open access panel exposing a re-closable closure and an air supply conduit system according to one or more embodiments of the present invention.

FIG. 5B is an enlarged front view of an example of an access panel 572, shown in FIG. 5A, but held in an opened position against the force of spring-loaded hinge 574. A latch, hook, magnet, or other device can be provided to maintain access panel 572 in an open position, for example, during cleaning of pipe 524. FIG. 5B also shows opening 578 in back wall 576, which is accessible because of the opened position of access panel 572. As can be seen from FIGS. 5A and 5B, grate 508 is located above pipe 524. Re-closable closure 570 can also be seen in FIG. 5B and is in the form of a threaded cap having a larger diameter than the diameter of pipe 524. Re-closable closure 570 can be accessed through opening 578, as shown. Re-closable closure 570 can be provided with a bar 592 for grabbing and turning re-closable closure 570 so that re-closable closure 570 can be unscrewed from and removed from the rearward end of pipe 524. Likewise, bar 592 can help facilitate screwing re-closable closure 570 onto the end of pipe 524. In some embodiments, re-closable closure 570 can instead be provided with a hex-nut, a wing-nut, or a like device for easily grabbing and turning re-closable closure 570, even when wearing an oven mitten or heavy gloves. In one or more embodiments the access panel and re-closable closure can be integral with one another or constitute the same structure, for example, so that when the access panel is opened the end of the conduit is simultaneously opened.

The present invention includes the following numbered aspects, embodiments, and features, in any order and/or in any combination:

1. An outdoor wood-burning boiler comprising:
   an enclosure comprising a sidewall;
   a wood support structure; and
   an air supply system configured for supplying air to burning wood supported by the wood support structure, the air supply system comprising one or more conduits for carrying a flow of air, the one or more conduits including at least one conduit that extends through the enclosure sidewall, comprises a first end located outside of the enclosure, and comprises a re-closable closure connected to the first end outside of the enclosure, the at least one conduit having an interior, the re-closable closure being configured to be opened outside of the enclosure and provide access to the interior of the at least one conduit.

2. The outdoor wood-burning boiler of any preceding or following embodiment/feature/aspect, wherein the at least one conduit also extends through the enclosure sidewall at a second location and further comprises:

a second end outside of the enclosure; and a second re-closable closure connected to the second end outside of the enclosure, wherein the second re-closable closure is configured to be opened outside of the enclosure, the second re-closable closure is configured to provide access to the interior of the at least one conduit, and the re-closable closure and the second re-closable closure are positioned such that when both are opened a cleaning implement can be extended through the first end, completely through the interior of the at least one conduit, and out of the at least one conduit through the second end.

3. The outdoor wood-burning boiler of any preceding or following embodiment/feature/aspect, wherein the sidewall comprises a first sidewall and a second, opposite sidewall, the at least one conduit is U-shaped, and the first end and the second end are both located outside of and on the same side of the first sidewall.

4. The outdoor wood-burning boiler of any preceding or following embodiment/feature/aspect, wherein the sidewall comprises a first sidewall and a second, opposite sidewall, the first end extends through the first sidewall, and the second end extends through the second, opposite sidewall.

5. An outdoor wood-burning boiler comprising:

an enclosure comprising a sidewall and an access panel formed in the sidewall;

a wood support structure;

an air supply system configured for supplying air to burning wood supported by the wood support structure, the air supply system comprising one or more conduits for carrying a flow of air, the one or more conduits including at least one conduit having a first end within the enclosure and adjacent the access panel, and a re-closable closure connected to the first end and adjacent the access panel, wherein the at least one conduit has an interior, the re-closable closure is positioned such that when the access panel is opened the re-closable closure can be accessed, and the re-closable closure is configured to provide access to the interior of the at least one conduit.

6. The outdoor wood-burning boiler of any preceding or following embodiment/feature/aspect, wherein the access panel is removable from the enclosure.

7. The outdoor wood-burning boiler of any preceding or following embodiment/feature/aspect, wherein the enclosure comprises a hinge and the access panel is connected to the enclosure by the hinge.

8. The outdoor wood-burning boiler of any preceding or following embodiment/feature/aspect, wherein the enclosure comprises a second access panel formed in the sidewall, the at least one conduit has a second end within the enclosure and adjacent the second access panel, the at least one conduit comprises a second re-closable closure connected to the second end and adjacent the second access panel, and the re-closable closure and second re-closable closure are positioned such that when the access panel and the second access panel are opened, the re-closable closure is opened, and the second re-closable closure is opened, a cleaning implement can be extended through the access panel, completely through the interior of the at least one conduit, and out of the enclosure through the second access panel.

9. The outdoor wood-burning boiler of any preceding or following embodiment/feature/aspect, wherein the sidewall comprises a first sidewall and a second, opposite sidewall, the at least one conduit is U-shaped, and the access panel and the second access panel are both located on the first sidewall.

10. The outdoor wood-burning boiler of any preceding or following embodiment/feature/aspect, wherein the sidewall comprises a first sidewall and a second, opposite sidewall, the access panel is located on the first sidewall, and the second access panel is located on the second, opposite sidewall.

11. An air supply conduit system for an outdoor wood-burning boiler, the system comprising:

one or more tubular conduits each having an interior and defining an air flow path, at least one of the one or more tubular conduits having an end and comprising a re-closable closure at the end, the re-closable closure being configured to be opened to provide access to the interior of the at least one tubular conduit for cleaning the interior; and one or more inlets configured to be connected to an air movement device for supplying a flow of air through the one or more interiors, wherein the one or more tubular conduits have one or more air supply ports formed therein for directing respective portions of a flow of air out of the one or more interiors, and the end is free of air supply ports.

12. The air supply conduit system of any preceding or following embodiment/feature/aspect, wherein the at least one tubular conduit comprises two tubular conduits that are parallel to each other, each of the two parallel conduits has two ends, and the system comprises a respective re-closable closure at each of the two ends of each of the two parallel conduits.

13. The air supply conduit system of any preceding or following embodiment/feature/aspect, wherein the one or more tubular conduits comprise a U-shaped conduit having the end and a second end, and the second end comprises a second re-closable closure.

14. The air supply conduit system of any preceding or following embodiment/feature/aspect, wherein the re-closable closure comprises a removable threaded closure and the end comprises threads configured to engage the removable threaded closure.

15. The air supply conduit supply system of any preceding or following embodiment/feature/aspect, wherein the removable threaded closure has threads on an external surface thereof and the end has internal threads.

16. The air supply conduit system of any preceding or following embodiment/feature/aspect, wherein the one or more inlets comprise a second re-closable closure configured to be opened to provide access to the interior of the at least one tubular conduit.

17. The air supply conduit system of any preceding or following embodiment/feature/aspect, wherein the re-closable closure and the second re-closeable closure are aligned with one another.

The present invention can include any combination of these various features or embodiments above and/or below as set forth in sentences and/or paragraphs. Any combination of disclosed features herein is considered part of the present invention and no limitation is intended with respect to combinable features.

The entire contents of all references cited in this disclosure are incorporated herein in their entireties, by reference. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether such ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. An air supply conduit system for an outdoor wood-burning boiler, the system comprising:

one or more tubular conduits each having an interior and defining an air flow path, at least one of the one or more tubular conduits having an end and comprising a re-closable closure at the end, the re-closable closure being configured to be opened to provide access to the interior of the at least one tubular conduit for cleaning the interior; and one or more inlets configured to be connected to an air movement device for supplying a flow of air through the one or more interiors, wherein the one or more tubular conduits comprise a sidewall and have one or more air supply ports formed in the sidewall for directing respective portions of a flow of air out of the one or more interiors, the end is configured to extend outside of a boiler enclosure, the end comprises a sidewall, and the end has no air supply ports in its sidewall.

2. The air supply conduit system of claim 1, wherein the at least one tubular conduit comprises two tubular conduits that are parallel to each other, each of the two parallel conduits has two ends, and the system comprises a respective re-closable closure at each of the two ends of each of the two parallel conduits.

3. The air supply conduit system of claim 1, wherein the re-closable closure comprises a removable threaded closure and the end comprises threads configured to engage the removable threaded closure.

4. The air supply conduit supply system of claim 3, wherein the removable threaded closure has threads on an external surface thereof and the end has internal threads.

5. The air supply conduit system of claim 1, wherein the one or more inlets comprise a second re-closable closure configured to be opened to provide access to the interior of the at least one tubular conduit.

6. The air supply conduit system of claim 5, wherein the re-closable closure and the second re-closeable closure are aligned with one another.

7. The air supply conduit system of claim 1, further comprising an air movement device connected to the one or more inlets, wherein the air movement device comprises a blower.

* * * * *